US009028269B2

(12) United States Patent
Hsu et al.

(10) Patent No.: US 9,028,269 B2
(45) Date of Patent: May 12, 2015

(54) ELECTRICAL CONNECTOR WITH IMPROVED METAL SHELL

(71) Applicant: Hon Hai Precision Industry Co., Ltd., New Taipei (TW)

(72) Inventors: Kuo-Chun Hsu, New Taipei (TW); Terrance F. Little, Fullerton, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 84 days.

(21) Appl. No.: 13/854,978

(22) Filed: Apr. 2, 2013

(65) Prior Publication Data

US 2013/0303027 A1 Nov. 14, 2013

(30) Foreign Application Priority Data

May 14, 2012 (TW) ..... 101209061 U

(51) Int. Cl.
*H01R 13/627* (2006.01)
*H01R 13/518* (2006.01)
*H01R 13/6582* (2011.01)

(52) U.S. Cl.
CPC ..... *H01R 13/518* (2013.01); *H01R 13/6582* (2013.01)

(58) Field of Classification Search
USPC ..... 439/357, 607.4
See application file for complete search history.

(56) References Cited

U.S. PATENT DOCUMENTS

| | | | | |
|---|---|---|---|---|
| 5,362,249 | A * | 11/1994 | Carter | 439/357 |
| 5,772,461 | A * | 6/1998 | Yu | 439/352 |
| 6,234,827 | B1 * | 5/2001 | Nishio et al. | 439/357 |
| 6,431,887 | B1 * | 8/2002 | Yeomans et al. | 439/108 |
| 6,902,432 | B2 * | 6/2005 | Morikawa et al. | 439/607.41 |
| 7,438,595 | B2 * | 10/2008 | Saito | 439/607.01 |
| 7,465,181 | B1 * | 12/2008 | Bridges et al. | 439/358 |
| 7,753,729 | B2 * | 7/2010 | Wang | 439/607.01 |
| 7,892,007 | B2 * | 2/2011 | Scherer et al. | 439/329 |
| 8,083,535 | B2 * | 12/2011 | Chang | 439/357 |
| 8,287,299 | B2 * | 10/2012 | Ray et al. | 439/353 |
| 8,439,708 | B2 * | 5/2013 | Colantuono et al. | 439/660 |
| 8,747,142 | B2 * | 6/2014 | Zhang et al. | 439/354 |
| 2014/0024263 | A1 * | 1/2014 | Dong et al. | 439/660 |

FOREIGN PATENT DOCUMENTS

| | | |
|---|---|---|
| TW | 545753 | 8/2003 |
| TW | M394617 | 12/2010 |

* cited by examiner

*Primary Examiner* — Neil Abrams
(74) *Attorney, Agent, or Firm* — Wei Te Chung; Ming Chieh Chang

(57) ABSTRACT

An electrical connector includes a metal shell defining several walls and a mating cavity formed by the walls commonly, an insulative housing shielded by the metal shell, and a plurality of contacts set in the housing. The housing has a base portion and mating tongue disposed in the mating cavity, the plurality of contacts provide contacting portions exposed upon a mating face of the mating tongue. A first wall of the metal shell parallel to the mating face defines a latching arm extending into the mating cavity, and the latching arm defines a latching portion and a rigid grounding section for improving EMI shielding.

20 Claims, 15 Drawing Sheets

ELECTRICAL CONNECTOR WITH IMPROVED METAL SHELL

FIELD OF THE INVENTION

The present invention relates generally to an electrical connector, and more particularly to an electrical connector having an improved metal shell which provides a grounding portion on at least one latching arm for further EMI shielding.

DESCRIPTION OF THE RELATED ART

Taiwan Pat. No. M394617 issued to Hamburg Industries Co., Ltd on Dec. 11, 2010 discloses an electrical connector including an insulative housing, a plurality of contacts received in the housing and a metal shell covering the housing. The shell includes a top wall, a bottom wall facing to the top wall, a pair of sidewalls connecting the top wall with the bottom wall and a mating cavity surrounded by the walls. The top wall and bottom wall each defines a pair of latching arms extending forwardly and projecting into the mating cavity, and the top wall further defines a first grounding arm disposed between the latching arms and extending rearward. Each side wall defines a second grounding arm extending rearward. The latching arms clip a mating connector for retaining the mating connector in the mating cavity, and the first and second grounding arms contact with a mating shell of the meting connector for EMI shielding. However, the first and second grounding arms provide poor EMI shielding, and there is no any more space to set more grounding members.

Hence, a new design which can provide excellent EMI shielding and has a compact size is required.

SUMMARY OF THE INVENTION

Accordingly, an object of the present invention is to provide an electrical connector with a metal shell which has a grounding portion on at least one latching arm for EMI shielding.

In order to achieve the object set forth, an electrical connector for mating with a mating connector which is shielded by a mating shell, includes a metal shell defining several walls and a mating cavity formed by the walls commonly, an insulative housing shielded by the metal shell, and a plurality of contacts set in the housing. The housing has a base portion and mating tongue disposed in the mating cavity, the plurality of contacts provide contacting portions exposed upon a mating face of the mating tongue. A first wall of the metal shell parallel to the mating face defines a latching arm extending into the mating cavity, and the latching arm defines a latching portion for latching with the mating shell and a rigid grounding section for contacting with the mating shell.

Other objects, advantages and novel features of the invention will become more apparent from the following detailed description of the present embodiment when taken in conjunction with the accompanying drawings.

DETAILED DESCRIPTION OF THE INVENTION

Figure 1:
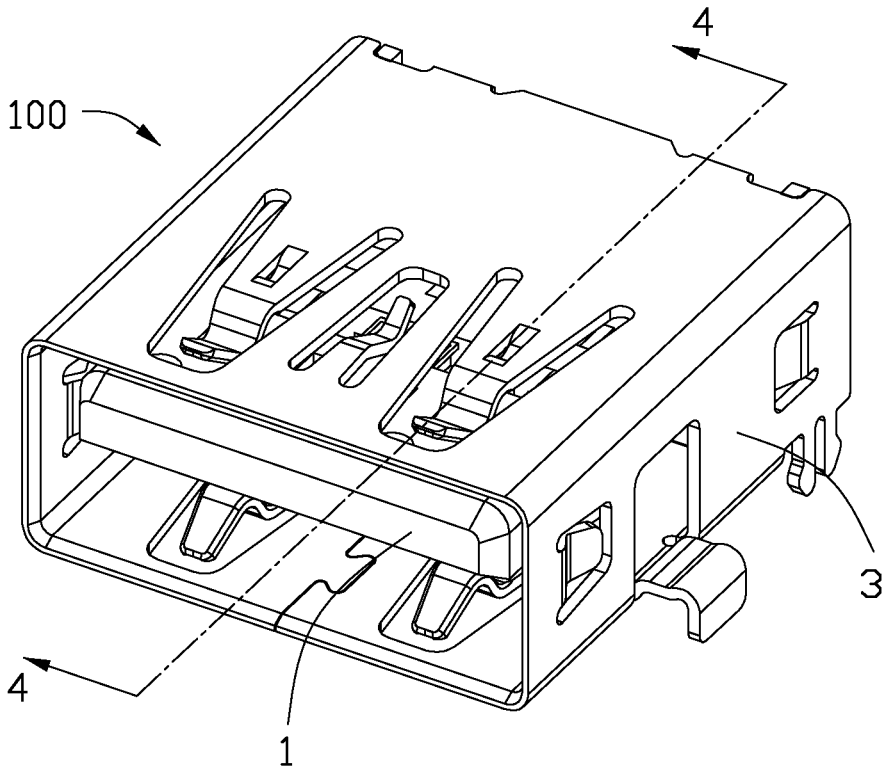
FIG. 1 is an assembled, perspective view of an electrical connector in accordance with a first embodiment of the present invention.

Reference will now be made to the drawing figures to describe preferred embodiments of the present invention in detail.

FIGS. 1 to 4 show an electrical connector 100 in accordance with a first embodiment of the present invention. The electrical connector 100 is mounted upon a printed circuit board to mate with a mating connector which is shielded by a mating shell. The electrical connector 100 includes an insulative housing 1, a plurality of contacts 2 retained in the housing 1, a metal shell 3 covering the housing 1, and a spacer 4 retained at a rear portion of the housing 1.

Figure 2:
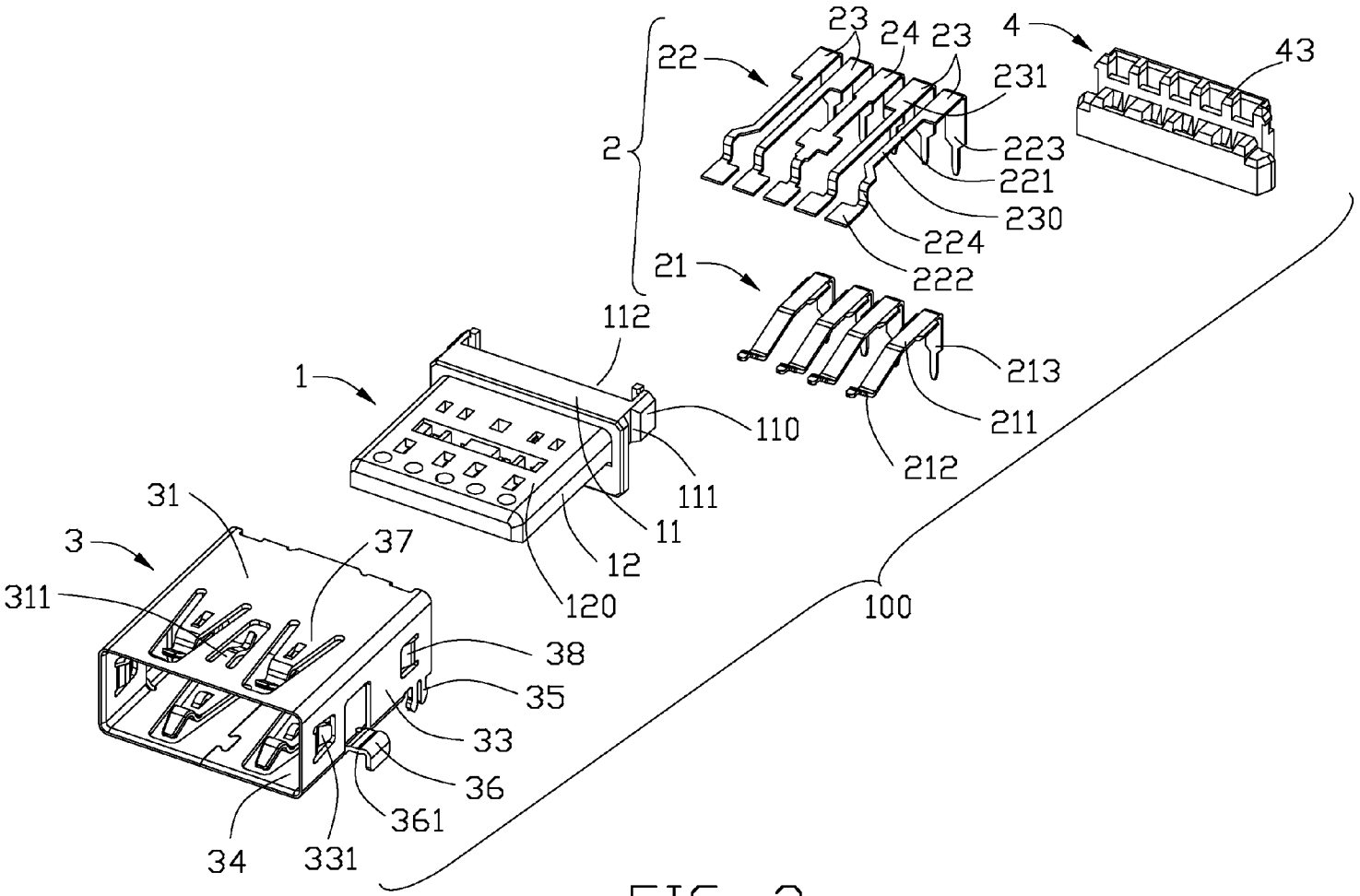
FIG. 2 is an exploded perspective view of the electrical connector shown in FIG. 1.
Figure 3:
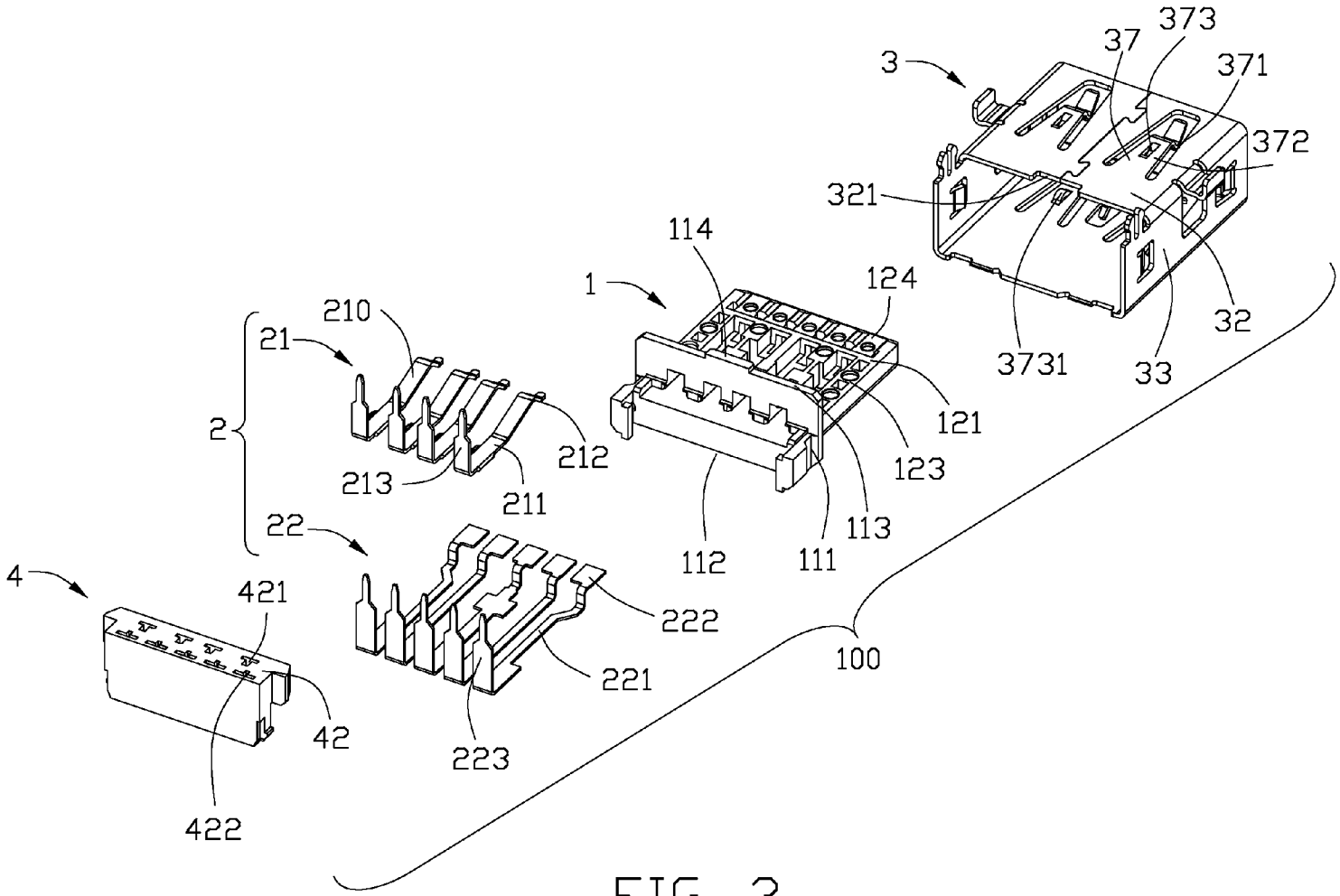
FIG. 3 is another exploded perspective view of the electrical connector shown in FIG. 2.

Referring to FIG. 2 and FIG. 3, the housing 1 defines a rear base portion 11 and a front mating tongue 12 extending forwardly from the base portion 11. The base portion 11 defines a pair of locking projections 110 extending rearward and facing to each other, and a receiving room 112 disposed between the two locking projections 110. Each locking projection 110 defines a locking slot 111 at an outer surface thereof. A protrusion 114 downwardly extends from a bottom face 113 of the base portion 11. The mating tongue 12 defines opposite top face 120 and mating face 121, four first receiving slots 123 are arranged at a rear portion of the mating face 121 along a lengthwise direction thereof, and five second receiving slots 124 are arranged at a front portion of the mating face 121 along the lengthwise direction and staggered with the first receiving slots 123.

The plurality of contacts 2 include four first contacts 21 and five second contacts 22. Each first contact 21 defines a first retaining portion 211, a first contacting portion 212 disposed at a free end of an elastic contacting arm 210, and a first soldering leg 213 bending from the first retaining portion 211. Each elastic contacting arm 210 is received in a corresponding first receiving slot 123, and the first contacting portion 212 projects out of the mating face 121, the first soldering leg 213 extends out of the housing 1.

Each second contact 22 defines a second retaining portion 221, a stiff second contacting portion 222 disposed in front of the second retaining portion 221 and a second soldering leg 223 bending from the second retaining portion 221. In this embodiment, the five second contacts 22 are defined as two pairs of differential pairs 23 for signal transmission and a grounding contact 24 disposed between the two differential pairs 23. An outmost contact 230 of each differential pairs 23 defines a bending portion 224 bending outwards to extend away from the inner contact 231 of each differential pairs 23 for improving cross-talk. The five second contacts 22 are molded in the housing 1 with the second retaining portions 221 embedded in the housing 1 and the second contacting portions 222 received in the corresponding second receiving slots 124. The second soldering legs 223 extend out of the housing 1.

Figure 4:
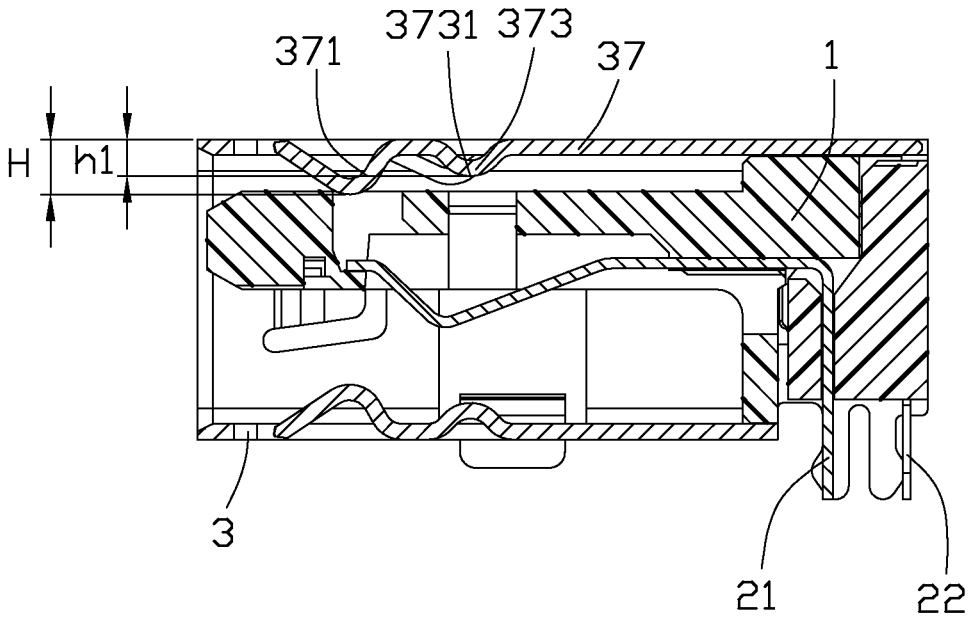
FIG. 4 is a cross-section view of the electrical connector taken along line 4-4 of FIG. 1.

Referring to FIG. 1 to FIG. 4, the metal shell 3 of frame shape defines top wall 31, a bottom wall 32 facing to the top wall 31, a pair of sidewalls 33 connecting with the top wall 31 and the bottom wall 32, and a mating cavity 34 defined by the four walls commonly. The top wall 31 and the bottom wall 32 each defines a pair of latching arms 37 forwardly extending and spaced from each other. Each latching arm 37 defines a planar body portion 372 and an inward-arced latching portion 371 extending into the mating cavity 34 from the body portion 372 for latching into a window which is disposed in a mating shell of the mating connector. A rigid rib portion 373 projecting into the mating cavity 34 is punched from each body portion 372 to act as a grounding section, the front and rear ends of the rib portion 373 integrally connect with the body portion 372, and the two sides are punched to separate from the body portion 372. The rib portion 373 provides an arc-shaped contacting face 3731 disposed in the mating cavity 34 as best shown in FIG. 4, which has no or little resilience thereby ensuring a reliably contacting described hereinafter. The latching portion 371 is disposed in the mating cavity 34 in a height H from the top wall 31, the rigid rib portion 373 is disposed in the mating cavity 34 in a first depth h1, and the height H is larger than the first depth h1, i.e. the latching portion 371 projects into the mating cavity 34 deeper than the rib portion 373 projecting. The top wall 31 further defines a grounding arm 311 disposed between the two latching arms 37 and extending rearward at a front portion thereof. Each sidewall 33 defines a locking leg 35 at a rear portion thereof and a soldering/supporting leg 36 having a supporting rib 361 which abuts against a peripheral region of a notch of the printed circuit board to have the whole connector be of a so-called sink type in the notch for lowing the whole profile of the connector on the printed circuit board. A restricting piece 38 is disposed above the locking leg 35, and a side arm 331 is provided at a front portion of the sidewall 33 and projecting into the mating cavity 34. A receiving recess 321 is defined at a rear edge of the bottom wall 32.

The spacer 4 defines a top face 43, a bottom face 42, and first and second through holes 421, 422 running through the top face 43 and the bottom face 42. The four first through holes 421 arrange in a front row, and the five second through holes 422 arrange in a rear row disposed behind the front row.

During assemblage, The second contacts 22 are embedded in the housing 1 with the second contacting portions 222 exposed in corresponding second receiving slot 124. The first contacts 21 are forwardly inserted into the housing 1 with the first retaining portions 211 fixed in the first receiving slot 123, the first contacting portions 212 extend beyond the mating face 121. The spacer 4 is upwardly assembled into the receiving room 112 and retained between the two locking arms 110, the four first soldering legs 213 run through the first through holes 421, and the five second soldering legs 223 run through the second through holes 422. The metal shell 3 shields outside of the housing 1, and the restricting piece 38 is restricted in the locking slot 111. The mating tongue 12 and the first and second contacting portions 212, 222 exposed upon the mating face 121 are disposed in the mating cavity 34. The grounding arm 311 and the side arms 331 may contact with the mating shell of the mating connector while the mating connector is inserted into the mating cavity 34, the latching portions 371 on the top and bottom walls lock into the window portions of the mating shell to retain the mating connector in the mating cavity 34 reliably. Synchronously, the contacting face 3731 of the rigid rib portion 373 contacts the mating shell. The grounding arm 311, the side arms 331 and the rib portions 373 contact with the mating shell which can improve EMI shielding, moreover, the rigid rib portion 373 is strong enough to clip the mating connector so as to make the latching arm 37 have both latching and grounding functions.

Figure 5:
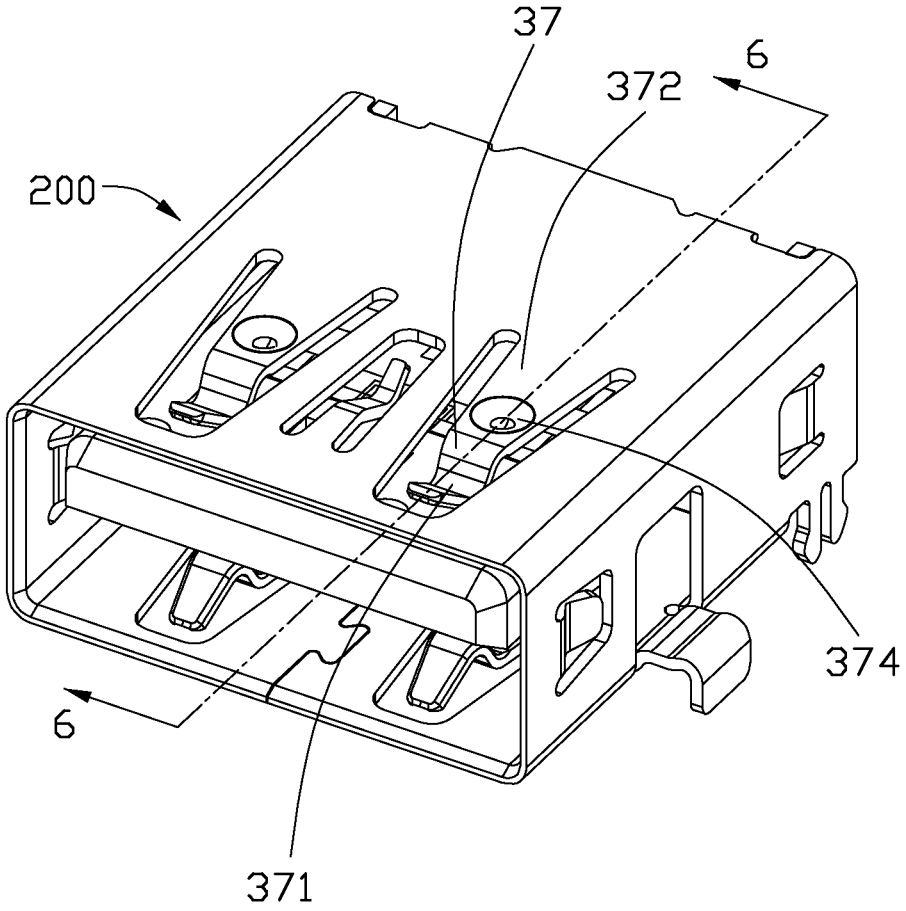
FIG. 5 is an assembled, perspective view of an electrical connector in accordance with a second embodiment of the present invention.
Figure 6:
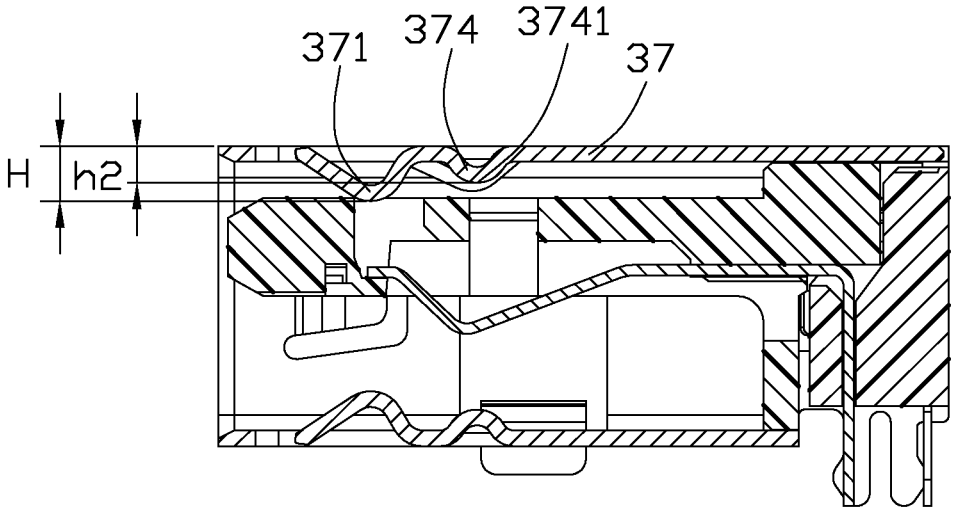
FIG. 6 is a cross-section view of the electrical connector taken along line 6-6 of FIG. 5.

FIG. 5 and FIG. 6 disclose a second embodiment of the present invention. The second electrical connector 200 has the similar structure with the electrical 100 except the latching arms 37. Each latching arm 37 of the second electrical connector 200 defines a body portion 372 and a latching portion 371 extending into the mating cavity 34 from the body portion 372 for latching into a window which is disposed in a mating shell of the mating connector. A rigid dome-shaped contacting portion 374 projecting into the mating cavity 34 for contacting with the mating shell is punched from each body portion 372 so as to act as a grounding section. The round edge of the dome-shaped contacting portion 374 integrally connects with the body portion 372. The dome-shaped contacting portion 374 without any resilience and provides a contacting face 3741 for contacting with mating shell, and the dome-shaped contacting portion 374 projects into the mating cavity 34 in a second depth h2 which is shallower than the height H that the latching portion 371 disposed in the mating cavity 34. The dome-shaped contacting portion 374 is rigid enough to clip the mating connector so as to make the latching arm 37 have both latching and grounding functions.

Figure 7:
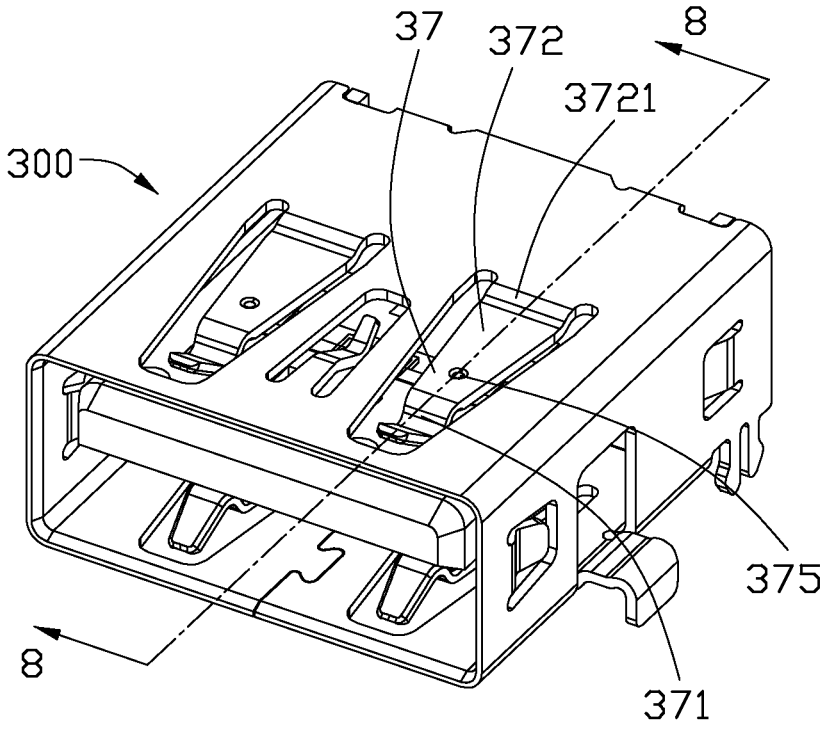
FIG. 7 is an assembled, perspective view of an electrical connector in accordance with a third embodiment of the present invention.
Figure 8:
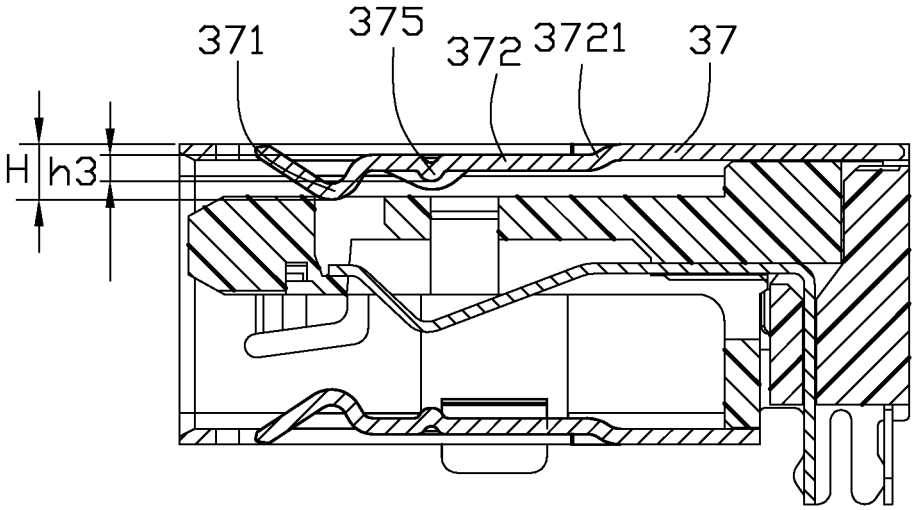
FIG. 8 is a cross-section view of the electrical connector taken along line 8-8 of FIG. 7.

FIG. 7 and FIG. 8 disclose a third embodiment of the present invention. The third electrical connector 300 has the similar structure with the electrical 100 except the latching arms 37. Each latching arm 37 of the third electrical connector 300 defines a body portion 372 extending from a bending portion 3721 extending toward the mating cavity 34, and a latching portion 371 bending into the mating cavity 34 from a front end of the body portion 372. A rigid raised or little dome-shaped portion 375 projecting into the mating cavity 34 for contacting with the mating shell is punched from each body portion 372 so as to act as a grounding section. The round edge of the raised portion 375 connects with the body portion 372. The height H that the latching portion 371 disposed in the mating cavity is lager than the third depth h3 that the raised portion 375 disposed in the mating cavity. Moreover, the bending portion 3721 makes the body portion 372 more closer to the mating cavity 34, so that the size of the raised portion 375 can be reduced comparing to the dome-shaped contacting portion 374 of the second connector 200. The second depth h2 that the dome-shaped contacting portion 374 disposed in the mating cavity 34 is larger than the third depth h3 that the raised portion 375 disposed in the mating cavity 34. The raised portion 375 without any resilience and is rigid enough to clip the mating connector so as to make the latching arm 37 have both latching and grounding functions.

Figure 9:
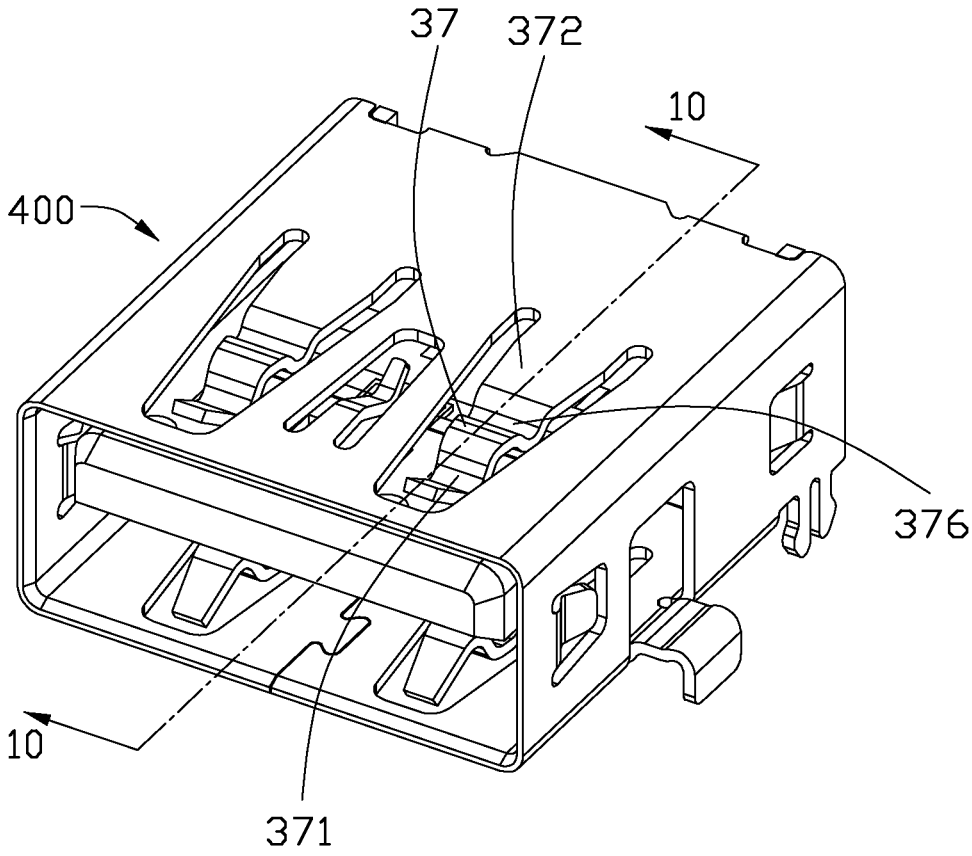
FIG. 9 is an assembled, perspective view of an electrical connector in accordance with a fourth embodiment of the present invention.
Figure 10:
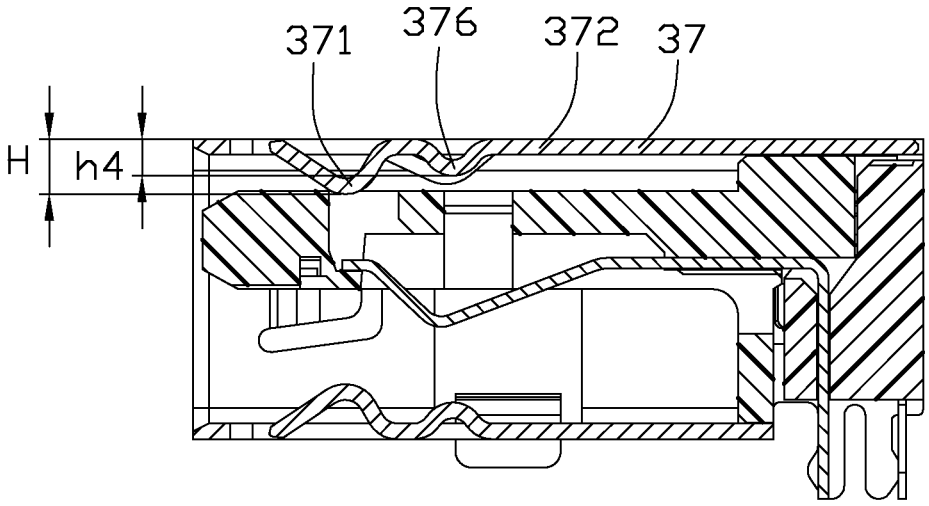
FIG. 10 is a cross-section view of the electrical connector taken along line 10-10 of FIG. 9.

FIG. 9 and FIG. 10 disclose a fourth embodiment of the present invention. The fourth electrical connector 400 has the similar structure with the electrical 100 except the latching arms 37. Each latching arm 37 of the fourth electrical connector 400 defines a body portion 372 and a latching portion 371 bending into the mating cavity 34 from a front end of the body portion 372. An arc-shaped step portion 376 projecting into the mating cavity 34 for contacting with the mating shell bents from each body portion 372 so as to act as a grounding section. The step portion 376 is disposed behind the latching portion 371 and projects into the mating cavity 34 in a fourth depth h4. The height H that the latching portion 371 disposed in the mating cavity is larger than the fourth depth h4. The arc-shaped step portion 376 is rigid enough to clip the mating connector so as to make the latching arm 37 have both latching and grounding functions. The step portion 376 is in a wave shape and has linear contacting face along a lateral direction of the latching arm 37, the latching portion 371 has a linear contacting face along the lateral direction of the latching arm 37, the dome-shaped contacting portions 374, 375 each has a point contacting portion.

Figure 11:
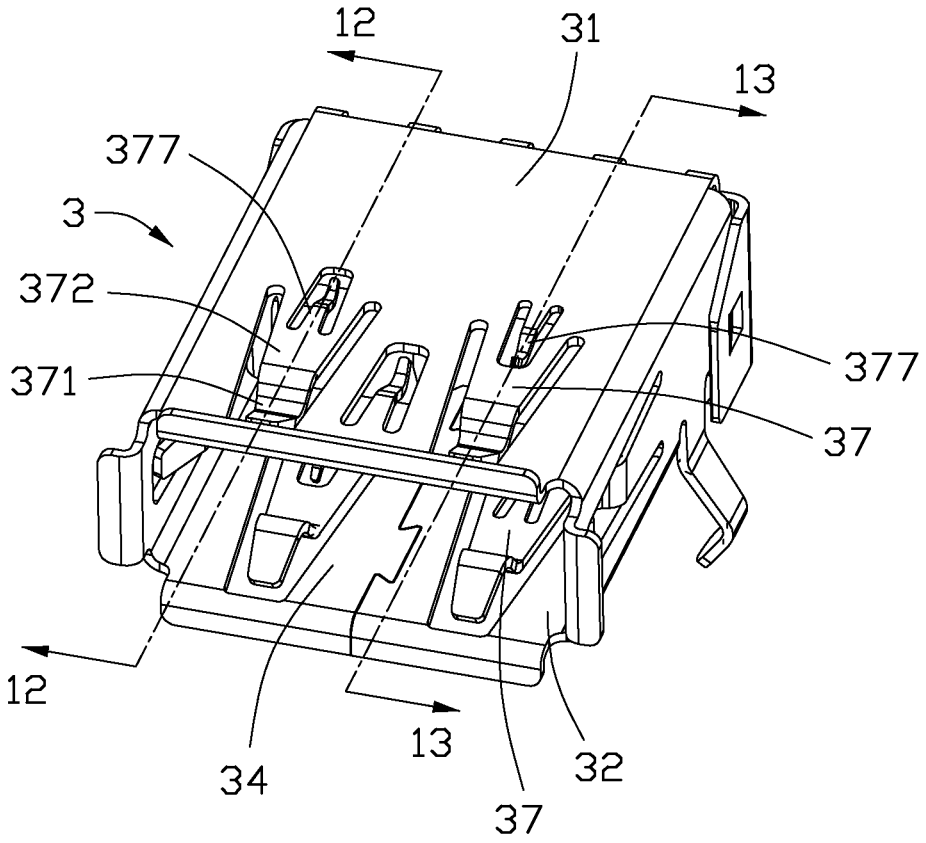
FIG. 11 is a perspective view of a metal shell in accordance with a fifth embodiment of the present invention.
Figure 12:
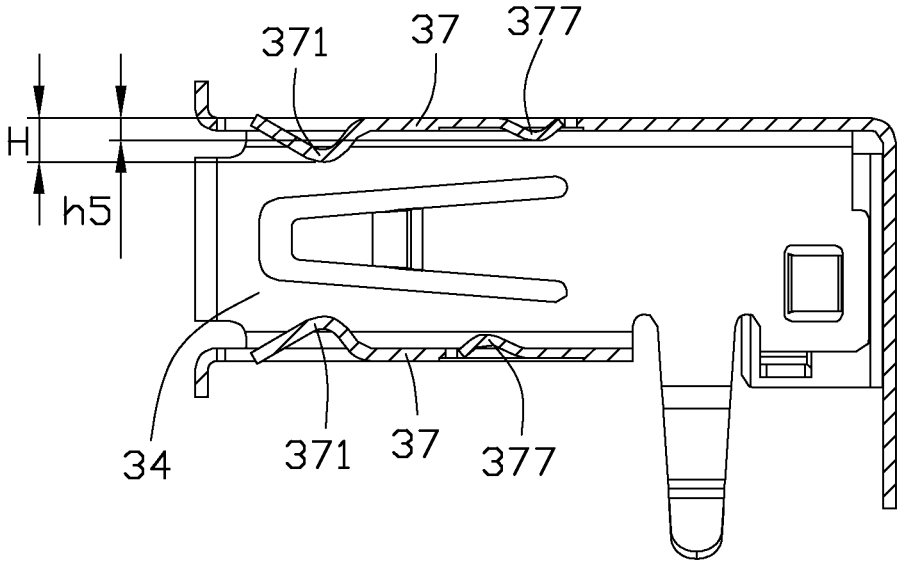
FIG. 12 is a cross-section view of the metal shell taken along line 12-12 of FIG. 11.
Figure 13:
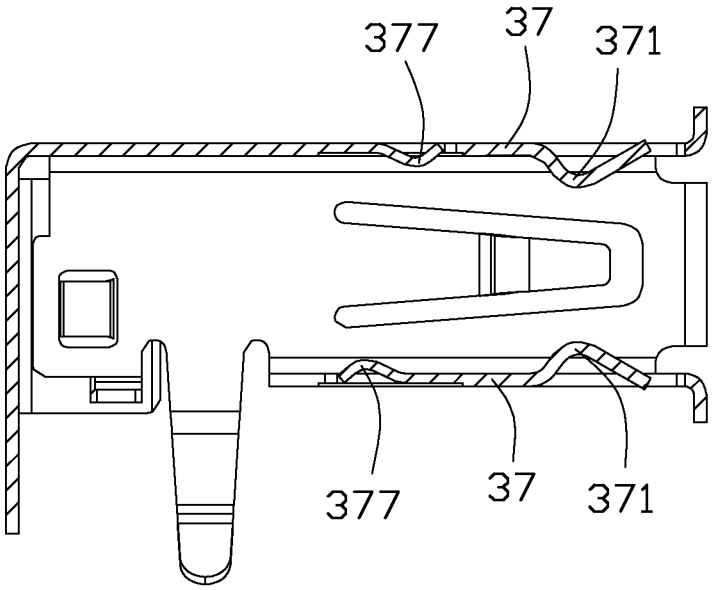
FIG. 13 is a cross-section view of the metal shell taken along line 13-13 of FIG. 11.

FIG. 11 to FIG. 13 discloses a metal shell 3 defined in a fifth embodiment of the present invention, which is used to surround an outer of the housing 1 with a rear base portion 11 and a front mating tongue 12 similar to the first embodiment, which is omitted in this embodiment since it is well known to a skill in this art. The top wall 31 defines a pair of latching arms 37 forwardly extending into the mating cavity 34. Each latching arm 37 defines a body portion 372 and a latching portion 371 bending into the mating cavity 34 from a front end of the body portion 372. A resilient arm 377 projecting into the mating cavity 34 for contacting with the mating shell is provided in each body portion 372 so as to act as a grounding section. Each resilient arm 377 is punched from the corresponding body portion 372 and integrally connects with the body portion 372 at one end thereof. The resilient arm 377 provided in one of the pair of latching arms 37 extends rearward from a middle portion of the body portion 32, and the resilient arm 377 disposed in the other latching arm 37 forwardly extends from a rear portion behind a root of the latching arm 37. The rearward extending resilient arm 377 extends beyond the root of the latching arm 37 to locate behind the foot from a middle portion of the body portion 372 that disposed in front of the root, the forwardly extending resilient arm 377 starts at a rear portion behind the root and forwardly extends across the root to locate in front of the root. The two resilient arms 377 defined in the top wall 31 extend in opposite direction. The height H that the latching portion 371 disposed in the mating cavity 34 is larger than a fifth depth h5 that the resilient arm 377 disposed in the mating cavity 34. The increased resilient arms 377 contact with the mating shell for improving EMI shielding, moreover, the rearward extending resilient arm 377 may guide the mating connector enter into the mating cavity 34 smoothly. The latching arms 37 defined in the bottom wall 32 also are provided with the same structure as that defined in the top wall 31. The forwardly extending resilient arm 377 defined in the bottom wall 32 faces to the rearward extending resilient arm 377 defined in the top wall 31, and the rearward extending resilient arm 377 defined in the bottom wall 32 faces to the forwardly extending resilient arm 377 defined in the top wall 31, which can balance the force that the latching arms 37 acted on the mating connector.

Figure 14:
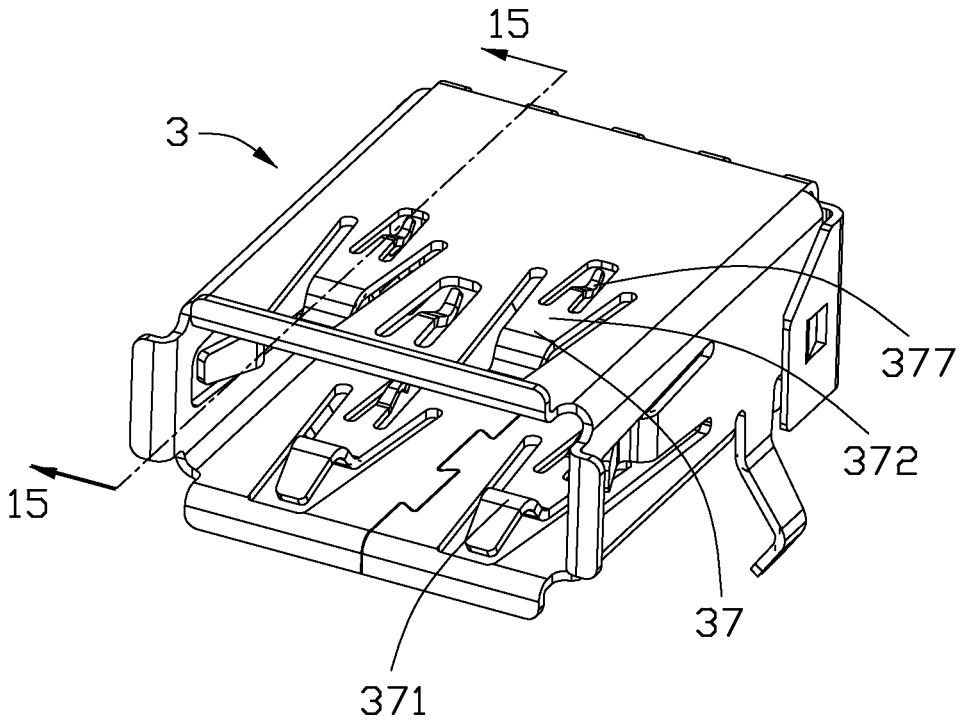
FIG. 14 is a perspective view of a metal shell in accordance with a sixth embodiment of the present invention.
Figure 15:
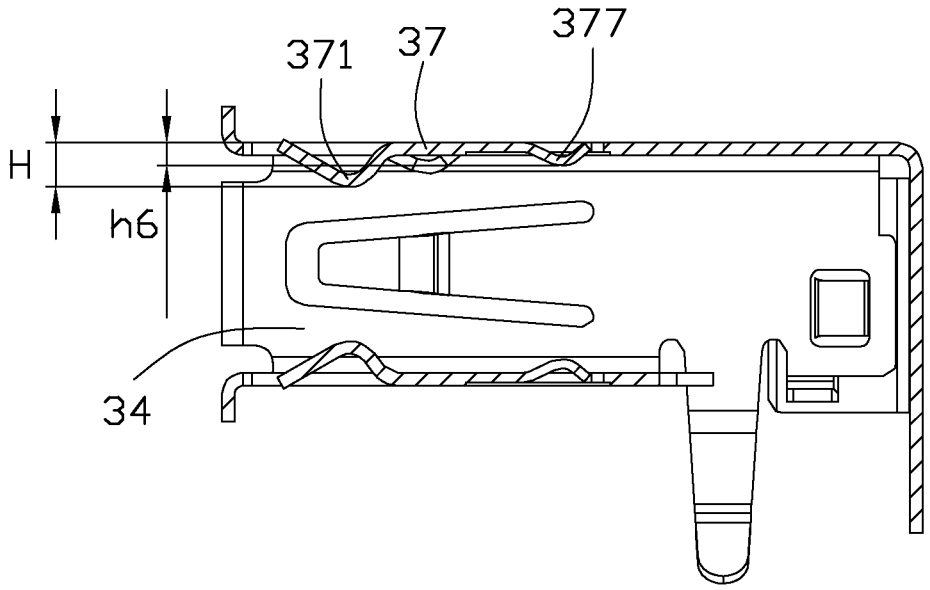
FIG. 15 is a cross-section view of the metal shell taken along line 15-15 of FIG. 14.

FIG. 14 and FIG. 15 disclose a metal shell 3 defined in a sixth embodiment of the present invention, which is used to surround an outer of the housing 1 with a rear base portion 11 and a front mating tongue 12 similar to the first embodiment, which is omitted in this embodiment since it is well known to a skill in this art. Different from the metal shell 3 defined in the fifth embodiment, the resilient arms 377 defined in the sixth embodiment all extend rearward from a middle portion of the body portion 372 and extend in a direction opposite to the latching arm 37. Each rearward extending resilient arm 377 extends beyond the root of the latching arm 37 to locate behind the foot from a middle portion of the body portion 372 that disposed in front of the root. The height H that the latching portion 371 disposed in the mating cavity 34 is larger than a sixth depth h6 that the resilient arm 377 disposed in the mating cavity 34. The increased resilient arms 377 contact with the mating shell for improving EMI shielding, moreover, the rearward extending resilient arms 377 may guide the mating connector enter into the mating cavity 34 smoothly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a mating connector which is shielded by a mating shell, comprising:
   - a metal shell defining several walls and a mating cavity formed by the walls commonly;
   - an insulative housing shielded by the metal shell, the housing having a rear base portion and a front mating tongue disposed in the mating cavity; and
   - a plurality of contacts set in the housing and providing contacting portions exposed upon a mating face of the mating tongue;
   - wherein a first wall of the metal shell parallel to the mating face defines a latching arm extending into the mating cavity, the latching arm defines a latching portion for latching with the mating shell and a rigid grounding section for contacting with the mating shell,
   - wherein the grounding section is defined as a rigid dome-shaped contacting portion punched from the latching arm, and the dome-shaped contacting portion defines a round edge integrally connecting with the latching arm.

2. The electrical connector as described in claim 1, wherein the first wall defines two forwardly extending latching arms and a grounding arm disposed between the two latching arms, and the grounding arm rearward extends into the mating cavity.

3. The electrical connector as described in claim 1, wherein the metal shell defines a second wall opposite to the first wall, and the second wall is provided with such another latching arm similar to the latching arm on the first wall.

4. The electrical connector as described in claim 1, wherein the latching arm defines a bending portion bending into the mating cavity from the first wall and a body portion forwardly extending from the bending portion, the body portion is disposed in a plane lower than the first wall, and the grounding section is punched from the body portion.

5. The electrical connector as described in claim 1, wherein the rigid grounding section is spaced rearwardly from the latching portion in a front-to-back direction and fixed upon the latching arm by the round edge integrally connecting with the latching arm.

6. An electrical connector comprising:
   - an insulative housing with contacts loaded thereof;
   - a metal shell surrounding and shielding the housing, the shell defining opposite two walls each defining a pair of latching arms slanting forwardly and inwards;
   - wherein each latching arm defines a planar body portion integrally connecting with the wall, a latching portion disposed at a front end thereof, and a grounding section disposed thereon, at least one grounding section extends rearward from a middle portion of the body portion to escape from the corresponding latching portion.

7. The electrical connector as described in claim 6, wherein the grounding section is defined as a resilient arm punched from the body portion and integrally connected with the body portion at one end thereof.

8. The electrical connector as described in claim 7, wherein both said latching arm and said resilient arm are cantilevered, and a root section of said resilient arm is spaced from and located rearwardly behind another root section of said latching arm.

9. The electrical connector as described in claim 6, wherein each wall defines a forwardly extending grounding section, and the two grounding sections defined on the same wall extend in opposite direction.

10. The electrical connector as described in claim 9, wherein the forwardly extending grounding section defined on one wall faces to the rearward extending grounding section defined on the opposite wall.

11. The electrical connector as described in claim 6, wherein the grounding sections all extend rearward in a same direction.

12. An electrical connector comprising:

an insulative housing defining a base with a mating tongue extending forwardly from the base along a front-to-back direction;

a metallic shell enclosing said housing and define a mating cavity in which said mating tongue extends, said shell defining a cantilevered latching arm with around a free front end an inward extending latching portion extending into the mating cavity in a vertical direction perpendicular to said front-to-back direction, and an inward protruding grounding portion unitarily formed on the latching arm and spaced rearwardly from the latching portion in said front-to-back direction, and the latching portion extending farther into the mating cavity than the grounding portion; wherein the grounding portion is fixed, around two opposite ends along the front-to-back direction, upon the latching arm, thus have less deflection with regard to the latching arm, in comparison with deflection performed by the latching portion with regard to the metallic shell.

13. The electrical connector as claimed in claim 12, wherein said metallic shell defines opposite upper and bottom walls, said latching arm is formed on each of said upper wall and said bottom wall opposite to each other in the vertical direction, and said shell defines a supporting leg having a horizontal portion which is positioned above the bottom wall of the shell.

14. The electrical connector as claimed in claim 12, further including a spacer attached behind the housing for regulating tails of the contacts.

15. The electrical connector as claimed in claim 12, wherein each of said contacts defines a contact point for mating with a corresponding terminal of a plug, and the grounding portion is closer to said contact point than the latching portion in the front-to-back direction.

16. The electrical connector as claimed in claim 12, wherein said latching arm extends horizontally instead of obliquely.

17. The electrical connector as claimed in claim 12, wherein said metallic shell defines opposite upper and bottom walls, said latching arm is formed on each of said upper wall and said bottom wall opposite to each other in the vertical direction, and said shell further defines a pair of board locks located behind the bottom wall in said front-to-back direction.

18. The electrical connector as claimed in claim 12, wherein a width of the grounding portion is smaller than that of the latching portion in a transverse direction perpendicular to both said front-to-back direction and said vertical direction.

19. The electrical connector as claimed in claim 12, wherein the grounding portion is essentially a rigid rib portion punched from the latching arm.

20. The electrical connector as claimed in claim 19, wherein the latching arm defines a planar body portion, the latching portion is disposed at a free end of the body portion, and the grounding portion is formed in the body portion.

* * * * *